United States Patent [19]

Fano et al.

[11] 4,037,867

[45] July 26, 1977

[54] SANITARY WASTE COLLECTOR

[76] Inventors: Joseph D. Fano, 85-17 150th St., Jamaica, N.Y. 11435; Fu Hwa, 82-78 167th St., Jamaica, N.Y. 11432

[21] Appl. No.: 639,389

[22] Filed: Dec. 10, 1975

[51] Int. Cl.[2] ..... A01K 29/00

[52] U.S. Cl. ..... 294/19 R; 15/257.5; 294/55

[58] Field of Search ..... 119/1; 294/1 R, 19 R, 294/50.9, 53.5, 55; 15/257.1, 257.2, 257.5, 257.6; 229/44 R, 44 CB, 52 R, 52 A, 52 AC, 52 AM

[56] References Cited

U.S. PATENT DOCUMENTS

| | | | |
|---|---|---|---|
| 1,188,677 | 6/1916 | Pike | 15/257.6 |
| 3,052,214 | 9/1962 | Johnson | 119/1 X |
| 3,685,088 | 8/1972 | Doherty | 294/1 R |
| 3,703,158 | 11/1972 | Lemler | 119/1 |
| 3,830,423 | 8/1974 | Prescott | 294/1 R |
| 3,854,578 | 12/1974 | Sharpe | 294/1 R X |
| 3,868,135 | 2/1975 | Magliaro | 119/1 X |

*Primary Examiner*—Jay N. Eskovitz
*Attorney, Agent, or Firm*—Allison C. Collard

[57] ABSTRACT

A sanitary waste collector has a disposable container forming a scoop. The container is loaded onto and carried by a rod and frame assembly. The eliminations of an animal may be captured directly into or be scooped into the container with the aid of a disposable scraper at the end of a separate spring loaded rod and handle assembly. When the container is filled it is sealed by pulling a pull ribbon attached to a folded flap at the bottom of the container and by pulling the flap over the front of and onto the top of the container and pressing the flap against an adhesive surface. The sealed container can drop out by inverting the rod and frame assembly.

10 Claims, 3 Drawing Figures

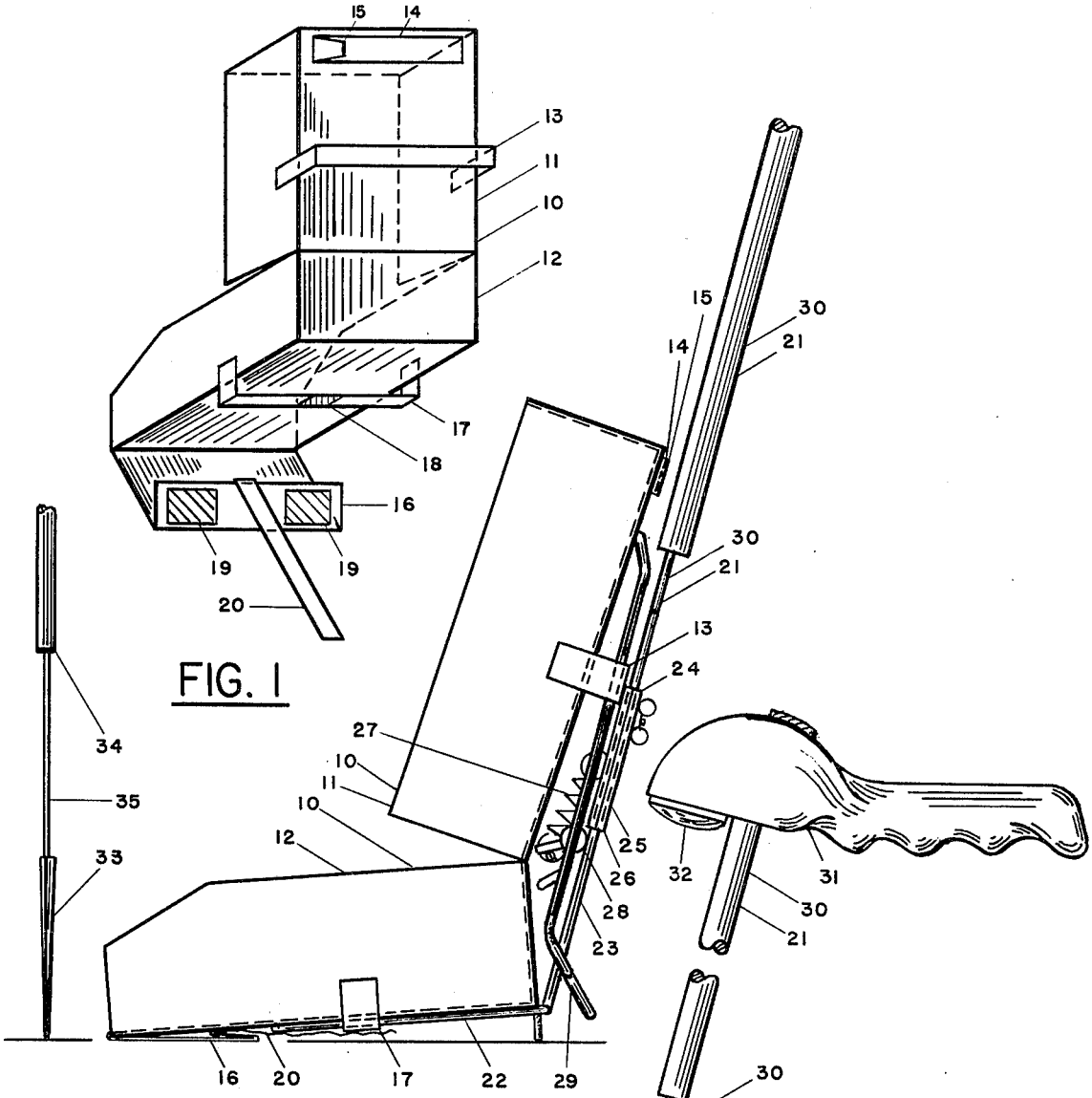
FIG. 1
FIG. 2
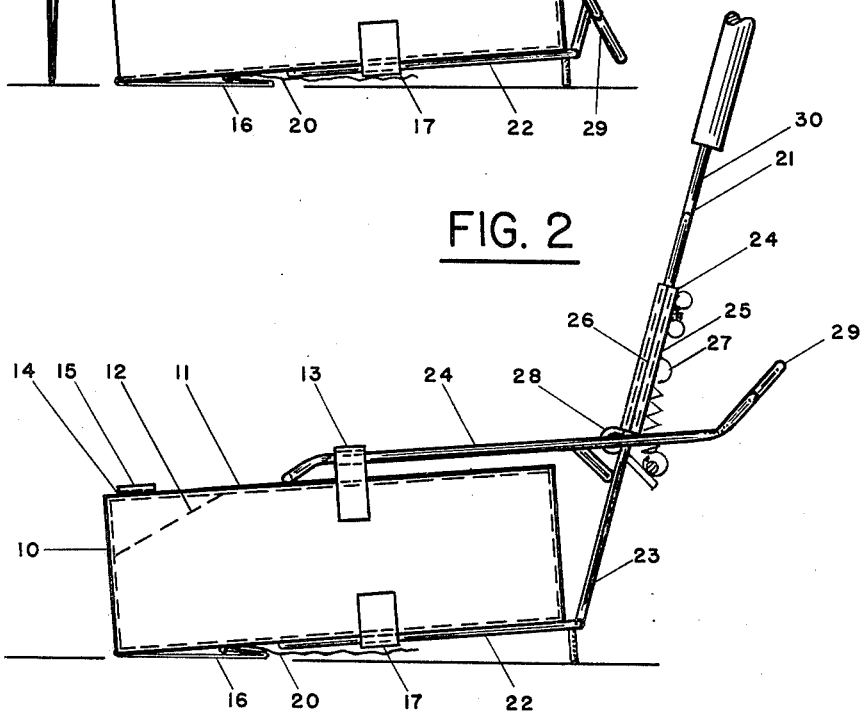
FIG. 3

SANITARY WASTE COLLECTOR

This invention relates to a sanitary waste collector and refers more particularly to a portable sanitation device for collecting the feces of animals.

An object of the present invention is to provide a device which can be used to collect animal feces in a simple and effective way with no human contact with contaminated surfaces.

Other objects of the present invention will become apparent in the course of the following specification.

In the accomplishment of the objectives of the present invention it was found desirable to provide a disposable container having the shape of a box with upper and lower covers. The bottom of the container has an extended folded flap. A pull ribbon is attached to the flap and may be used to seal the container. A separate frame assembly is used to carry the container. This frame assembly has a lower frame and a hinged cover frame connected with a spring. A separate adjustable plate carries the cover frame and the spring in order to accomodate varying container sizes. A separate spring loaded scraper rod with a disposable scraper may be removably attached to the frame assembly.

The invention will appear more clearly from the following detailed description when taken in connection with the accompanying drawing showing by example only, a preferred embodiment of the inventive idea.

In the drawing:

FIG. 1 is a perspective view of a container used as a waste receiver.

FIG. 2 is a side view of the waste receiver and frame assembly and scraper in the open position.

FIG. 3 is a side view of the waste receiver and frame assembly in the closed position.

The drawing shows a container 10 which consists of a flexible, water resistant bio-degradable material. The container 10 has a top 11 moveable over a bottom 12. The top 11 carries a loose tab 13 and a layer of adhesive 14 covered with a removable protective strip 15 close to its outer edge. The bottom 12 is extended to form a flap 16. The lower surface of the bottom 12 carries a tight tab 17 and a small layer 18 of adhesive. The flap 16 has an outer portion 19 coated by an adhesive. A pull ribbon 20 is attached to the flap portion 16 at one end and held in place on tab 17 by adhesive 18 at the other end. Flap 16 is held to the bottom 12 of container 10 by adhesive 19.

The described holding adhesives 18 and 19 must be of such quality that they allow ease in disengagement without damage but have enough strength to maintain the parts in proper positions during normal handling. The described adhesive 14 shall be of such quality that once the container 10 is sealed by pressing flap 16 against the adhesive it will maintain the sealed position during abnormal handling.

The container 10 can be carried by rod and frame assembly 21. This assembly has a lower frame 22 connected to a vertical frame 23 having parallel rods. A spring and top cover frame assembly 24 is mounted upon frame 23. The spring and top cover frame assembly 24 consists of a split plate forming vertical tubular portions 25 mounted upon the frame 23 and an intermediate flat portion 26 carrying one end of a spring 27. The portion 26 also carries two horizontal tubular portions 28. The cover frame is mounted in the tubes 28 and has a rearwardly extending projection 29 used for operating the cover. The cover frame 24 can be attached to the top 11 by the tab 13.

The rods of the frame 23 are joined to form an upper handle rod 30 and a handle 31 of any suitable shape. The handle carries a battery operated light 32.

The device also includes a separate disposable scraper 33 located at the end of a rod 34 loaded by a spring 35. The scraper 33 consists of a flexible, water resistant, bio-degradable material. It has sealed edges and an open envelope shape. The spring 35 is used to release the disposable scraper.

The disposable scraper rod 34 is connected for storage to the frame rod 30 by any suitable material or magnetic means or a combination of both (not shown).

In operation, the container 10 is placed upon the frame assembly 21 by passing lower frame 22 through tab 17 and top cover frame 24 through tab 13. Then the top 11 is opened by pressing down on extension 29 and it is held in the open position by spring 27. Thus an open front scoop is formed. The droppings of the animal may be captured directly or scooped into the container bottom 12 by the use of the separate scraper 33 carried by the spring loaded rod 34. Then the extension 29 of cover frame 24 is lifted by use of the toe of the foot.

If the animal eliminates again the cover 11 is opened by means described above, the feces are captured or scraped into the container bottom 12, and then the top of the container is closed in the above described manner.

The container can then be sealed by removing the protective strip 15, pulling ribbon 20 away from the bottom tab 17 and pulling extended flap 16 in front of and onto the container top 11. The pressing of the extended flap down against adhesive 14 affects a seal. Thus, contaminated surfaces are covered.

The closed and sealed container can be transported in the frame assembly until a convenient depository is reached. The user then inverts the frame assembly and slightly presses the cover frame 24 to relieve pressure. Then the sealed container will drop out by gravity.

It is apparent that numerous changes may be made in the described construction within the scope of the appended claims.

What is claimed is:

1. In a sanitary waste collector comprising in combination a disposable container, a support for said container, and cooperating means on said container and said support for opening and closing said container and detachably connected said container with said support, the improvement comprising:

said disposable container including a bottom portion, a top closure portion swingably connected with said bottom portion;

said bottom portion including a base portion, an upstanding rear portion fixed to said base portion, said swingable front portion including a front part complementary to said upstanding rear portion and a flap, said front part being swingably connected along an edge portion with said base portion for movement between a closed position and an open position positioned beneath said base portion;

said flap and said base portion including cooperating adhesive portions to hold said front part beneath said base portion in the open position of said container;

individual means connected with said base portion and said top closure portion detachably connecting said container with said support;

said support comprising a lower frame member and a vertical frame member fixed to each other and a moveable top cover frame member pivotally connected with said vertical frame member, said base portion being held to said lower frame member by said detachable connecting means, said top closure portions being held to said top cover frame by said detachable connecting means for movement between said open and said closed positions;

spring biasing means interconnecting said moveable top closure frame member and said vertical frame member urging said moveable frame member and said top closure portion into said closed position;

foot operated means connected with said moveable top closure frame member operable to overcome the force of said spring biasing means to move said moveable top closure frame and said top closure portions to said open position; and said front part and said base portion in said open position providing a free edge adapted to contact a ground surface, and said front part after removal from said support structure being swingable about said free edge to form a front upstanding wall with said base portion, and said top closure portion being adapted to enclose said front upstanding wall when said top closure portion is closed onto said bottom portion.

2. In a waste collector according to claim 1, further comprising:

a tight tab fixed to said bottom portion, said tight tab including adhesive means; and wherein said flap includes adhesive means adapted to engage said tab adhesive means to hold said front part under said base portion in said open position; and said tight tab fitting around said lower frame member to hold said bottom portion thereto.

3. In a waste collector according to claim 1, further comprising a tab connected with said top closure adapted to fit around said moveable top closure frame member for movement therewith.

4. In a waste collector according to claim 1, further comprising:

a layer of adhesive and a protective strap therefor on said top closure portion; and a pull ribbon connected with said flap adapted for locking engagement with said adhesive layer to lock said top closure portion with said bottom portion.

5. In a waste collector according to claim 2, further comprising a tab connected with said top closure adapted to fit around said moveable top closure frame member for movement therewith.

6. In a waste collector according to claim 5, further comprising:

a layer of adhesive and a protective strap therefor on said top closure portion; and a pull ribbon connected with said flap adapted for locking engagement with said adhesive layer to lock said top closure portion with said bottom portion.

7. In a waste collector according to claim 1, wherein said spring biasing means includes a spring.

8. In a waste collector according to claim 7, further comprising:

a layer of adhesive and a protective strap therefor on said top closure portion; and a pull ribbon connected with said flap adapted for locking engagement with said adhesive layer to lock said top closure portion with said bottom portion.

9. In a waste collector according to claim 8, further comprising a tab connected with said top closure adapted to fit around said moveable top closure frame member for movement therewith.

10. In a waste collector according to claim 2, further comprising:

a layer of adhesive and a protective strap therefor on said top closure portion; and a pull ribbon connected with said flap adapted for locking engagement with said adhesive layer to lock said top closure portion with said bottom portion.

* * * * *